US008375927B2

(12) United States Patent
Berger

(10) Patent No.: US 8,375,927 B2
(45) Date of Patent: Feb. 19, 2013

(54) INTERNAL COMBUSTION ENGINE HAVING A CRANKCASE FOR A PLURALITY OF CYLINDERS

(75) Inventor: Robert Berger, Pacher (AT)

(73) Assignee: AVL List GmbH, Graz (AT)

( * ) Notice: Subject to any disclaimer, the term of this patent is extended or adjusted under 35 U.S.C. 154(b) by 328 days.

(21) Appl. No.: 12/452,667

(22) PCT Filed: Jun. 23, 2008

(86) PCT No.: PCT/EP2008/057918

§ 371 (c)(1),
(2), (4) Date: Mar. 1, 2010

(87) PCT Pub. No.: WO2009/010370

PCT Pub. Date: Jan. 22, 2009

(65) Prior Publication Data

US 2010/0170484 A1 Jul. 8, 2010

(30) Foreign Application Priority Data

Jul. 17, 2007 (AT) ..... A 1130/2007

(51) Int. Cl.
*F01M 11/02* (2006.01)

(52) U.S. Cl. ..... 123/572; 123/196 R

(58) Field of Classification Search ..... 123/572–574, 123/41.86, 196 R
See application file for complete search history.

(56) References Cited

U.S. PATENT DOCUMENTS

| | | | | |
|---|---|---|---|---|
| 5,664,549 | A * | 9/1997 | Hutchins | 123/572 |
| 5,901,679 | A | 5/1999 | Tanaka et al. | |
| 6,065,458 | A | 5/2000 | Ozeki | |
| 6,234,154 | B1 * | 5/2001 | Spix | 123/572 |
| 7,047,955 | B2 * | 5/2006 | Ookawa et al. | 123/572 |
| 7,225,786 | B2 | 6/2007 | Kim | |
| 2004/0182350 | A1 * | 9/2004 | Fuchs | 123/188.8 |

FOREIGN PATENT DOCUMENTS

| | | |
|---|---|---|
| DE | 4324609 | 10/1997 |
| JP | 02052912 | 4/1990 |

OTHER PUBLICATIONS

English Abstract of DE 4324609.

* cited by examiner

*Primary Examiner* — M. McMahon
(74) *Attorney, Agent, or Firm* — Dykema Gossett PLLC

(57) ABSTRACT

An internal combustion engine has a crankcase for a plurality of cylinders, which has hollow vertical reinforcements in the area of the side walls of the crankcase in the area of the main bearing planes, at least a part of the vertical reinforcements being implemented as oil recirculation passages between cylinder head and crankcase. At least one vertical reinforcement which conducts blow-by gas has a connection for a blow-by gas line leading to an oil separator.

8 Claims, 6 Drawing Sheets

INTERNAL COMBUSTION ENGINE HAVING A CRANKCASE FOR A PLURALITY OF CYLINDERS

BACKGROUND OF THE INVENTION

1. Field of the Invention

The invention relates to an internal combustion engine having an engine block for a plurality of cylinders and which has hollow vertical reinforcements of the side walls of the engine block in the area of the main bearing planes, at least a part of the vertical reinforcements being implemented as oil recirculation passages between cylinder head and engine block.

2. The Prior Art

The publications DE 43 24 609 C2 and U.S. Pat. No. 7,225,786 B2 disclose crankcases having hollow vertical reinforcements which function as oil recirculation channels between cylinder head and crankcase. The hollow reinforcements are connected to one another by a longitudinal channel.

In reciprocating piston internal combustion engines, because of the high pressures and the back-and-forth movement of the pistons, combustion gases enter the crankcase via the piston rings. These combustion gases, also referred to as "blow by", increase the pressure in the crankcase, damage the lubricant oil, and make sealing the crankcase more difficult. The crankcase must therefore be ventilated. This is typically achieved by providing a connection is provided in the form of a ventilation line between the crankcase and the intake system of the reciprocating piston internal combustion engine. Therefore, no pollutants reach the environment. In order to keep the lubricant oil which is contained in the crankcase gases in finely distributed form and out of the intake system of the reciprocating piston internal combustion engine, oil separators are used, preferably having filters, via which the crankcase gases are conducted before they reach the intake system of the reciprocating piston internal combustion engine. Oil separators of this type are connected via a blow-by line to the crankcase. The configuration of the removal point for the blow-by line in the crankcase decisively influences the quantity of the entrained oil components.

The object of the invention is to allow a simple removal of the blow-by gases with the least possible oil component.

SUMMARY OF THE INVENTION

This is achieved according to the invention in that at least one vertical reinforcement which conducts blow-by gas has a connection for a blow-by gas line leading to an oil separator, preferably, a first group of vertical reinforcements being implemented as oil recirculation channels and a second group of vertical reinforcements being implemented as blow-by channels, so that the oil recirculation and the flow of blow-by gases occur essentially separately from one another.

Advantageously, the first vertical reinforcements are situated on a first longitudinal side and the second vertical reinforcements are situated on a second longitudinal side of the crankcase.

To prevent excessively high oil introduction into the blow-by gas line, it is provided that the first group of vertical reinforcements are connected to oil recirculation passages in the cylinder head and the second group of vertical reinforcements are connected to blow-by gas passages in the cylinder head, the mouths of the oil recirculation channels of the cylinder head being situated lower than the mouths of the blow-by gas channels.

In a particularly advantageous embodiment variant of the invention, the vertical reinforcement having the connection for the blow-by gas line has a flow connection via a connection channel to an adjacent vertical reinforcement, the connection channel preferably being situated in the area of the cylinders in the side wall of the crankcase. The connection channel has an oil separation edge in the area of the vertical reinforcement having the connection, on the bottom side farther away from the cylinder head. Oil which possibly enters the vertical reinforcement having the connection is thus separated even before flowing into the blow-by gas line. It is preferably provided that the connection channel is implemented as an oil collection chamber, in order to conduct separated oil into the adjacent vertical reinforcement. The separated oil can reach the oil chamber of the crankcase via the connection channel and the adjacent vertical reinforcement.

It can be provided that the vertical reinforcement having the connection is separated from the cylinder head by a cylinder head seal in the area of the cylinder head sealing surface, preferably except for an oil recirculation opening. Oil and blow-by gas flowing from the cylinder in the direction of the crankcase are thus captured. It is ensured by the oil recirculation hole that oil coming from the cylinder head intentionally flows into the oil collection chamber.

Furthermore, it is advantageous to achieve good separation rates if the vertical reinforcement having the connection is situated approximately in the area of an engine central plane.

BRIEF DESCRIPTION OF THE DRAWINGS

The invention is explained in greater detail hereafter on the basis of the figures. In the figures.

DETAILED DESCRIPTION OF THE PREFERRED EMBODIMENTS

Figure 1:
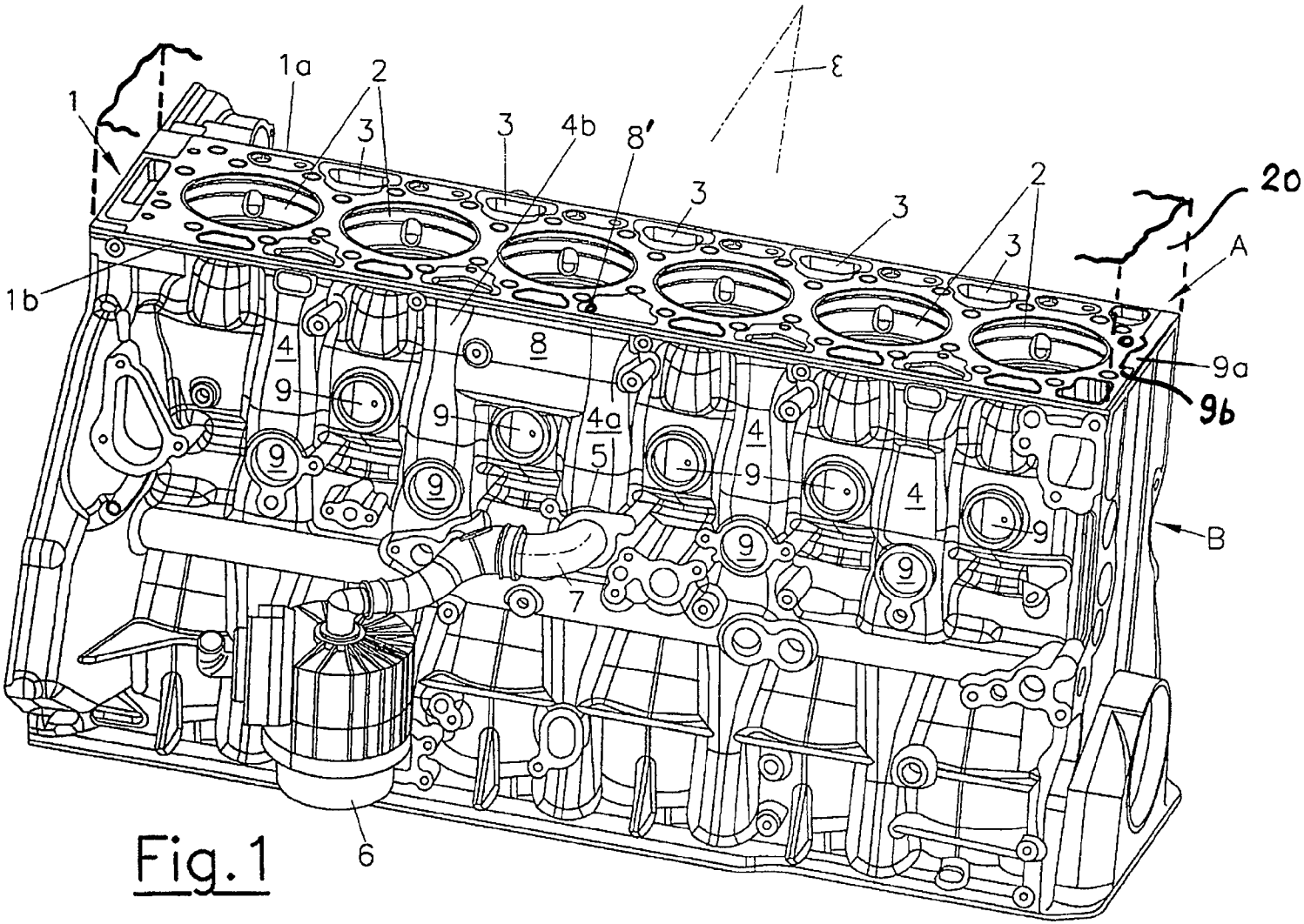
FIG. 1 shows a crankcase of an internal combustion engine according to the invention in a diagonal view including blow-by gas line and oil separation device in a first embodiment variant.

An engine block 1 for a plurality of cylinders 2 situated in a row has a first group A and a second group B of hollow vertical reinforcements 3, 4, 4*a*, 4*b* situated in the area of main bearing planes and in the area of the side walls 1*a*, 1*b*. The first group A of vertical reinforcements 3 is situated in the area of a first longitudinal side 1*a* of the engine block 1, and the second group B of hollow vertical reinforcements 4, 4*a*, 4*b* is situated in the area of a second longitudinal side 1*b* of the engine block 1. The first group A of vertical reinforcements 3 is implemented as oil recirculation passages and is connected to oil recirculation channels of the cylinder head 20 (not shown in greater detail). The second group B of vertical reinforcements 4, 4*a*, 4*b* is implemented as blow-by passages and also has a flow connection to blow-by gas channels of the cylinder head. The oil recirculation channels and blow-by gas channels of the cylinder head originate from the valve actuation chamber. In order to achieve a separation between recirculating oil and blow-by gases, the mouths of the oil recirculation channels in the cylinder head 20 are situated lower than the mouths of the blow-by gas channels.

A hollow vertical reinforcement 4*a* of the second group B, which is situated in the area of an engine central plane E, has a connection 5 for a blow-by gas line 7 leading to an oil separator 6. The oil separator 6 is flanged on the engine block 1. An exit channel (not shown in greater detail) of the oil separator 6 leads back to the engine block 1 again.

Figure 2:
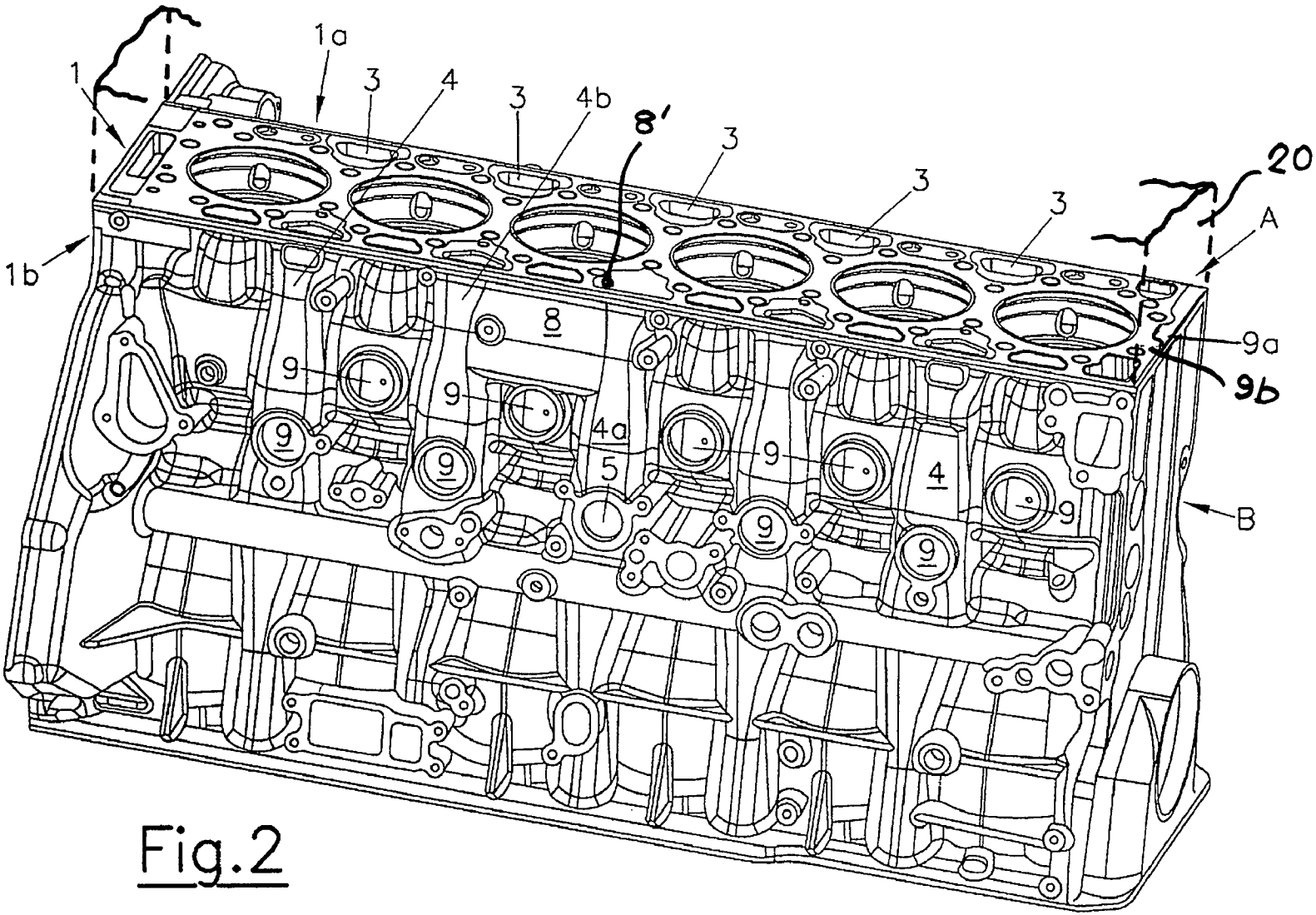
FIG. 2 shows the crankcase in a diagonal view without blow-by gas line.

FIG. 1 and FIG. 2 show an embodiment variant in which the vertical reinforcement 4*a*, which has the connection 5 for the blow-by gas line 7 is separated from the cylinder head except for an oil recirculation opening 8' in the area of the cylinder head sealing surface 9*a*. This prevents excessively large quantities of oil from reaching the blow-by gas line 7.

Figure 3:
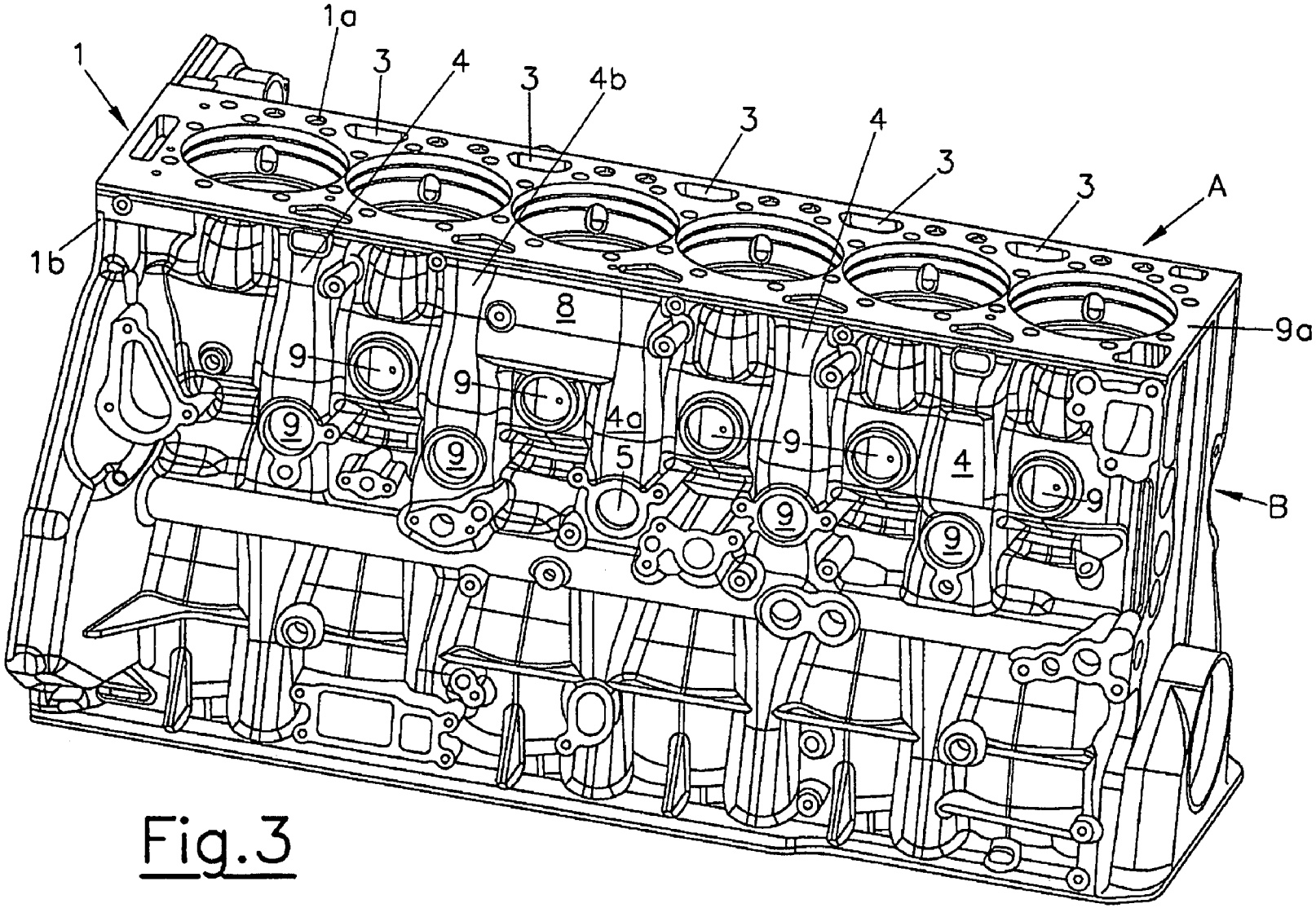
FIG. 3 shows the crankcase in a diagonal view in a second embodiment variant.
Figure 4:
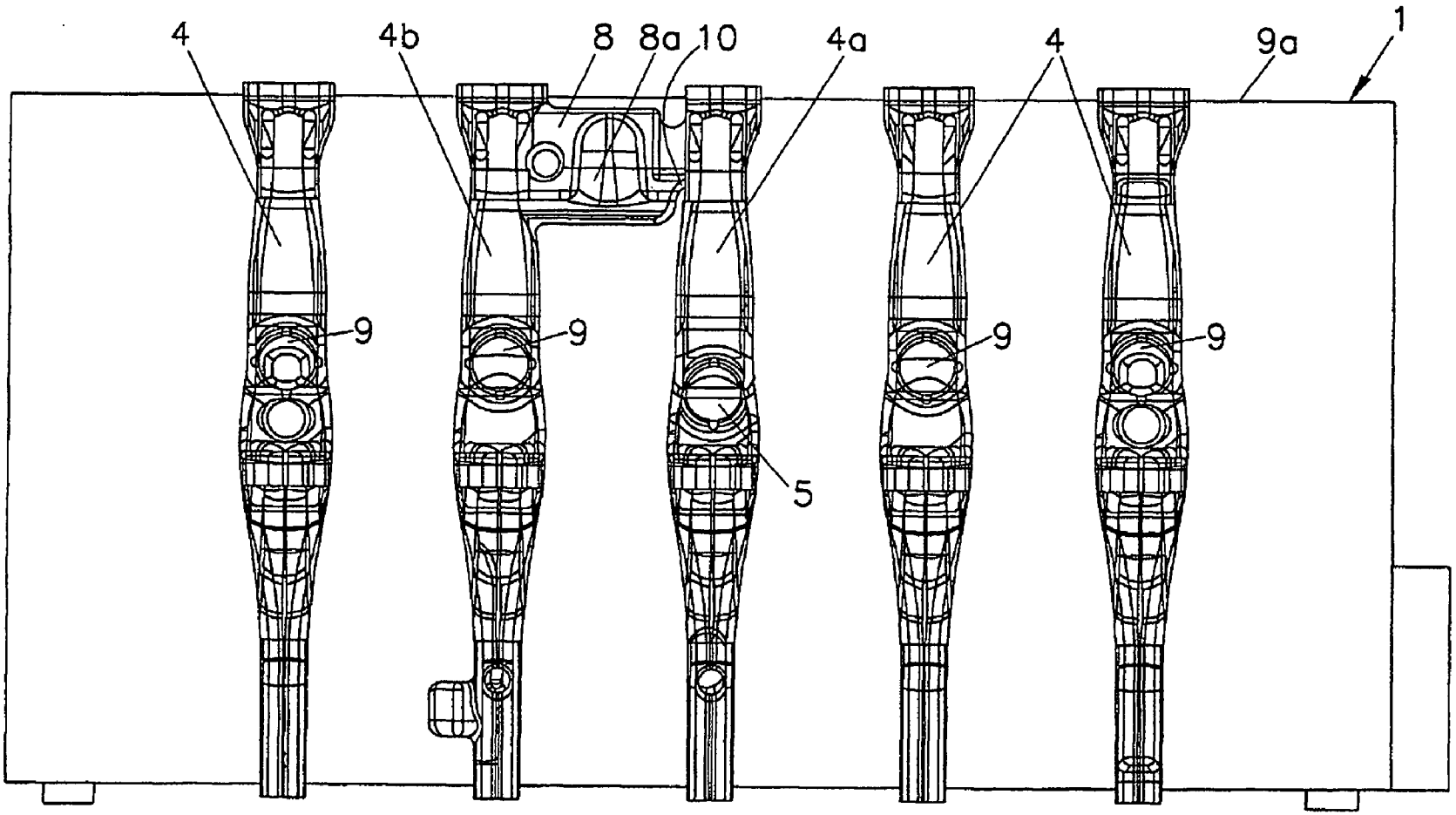
FIG. 4 shows the crankcase in a side view.

FIG. 3 shows an alternative embodiment variant in which the vertical reinforcement 4*a* is open toward the cylinder head. The flow interruption to the cylinder head can optionally be ensured by the cylinder head seal 9*b*.

Figure 5:
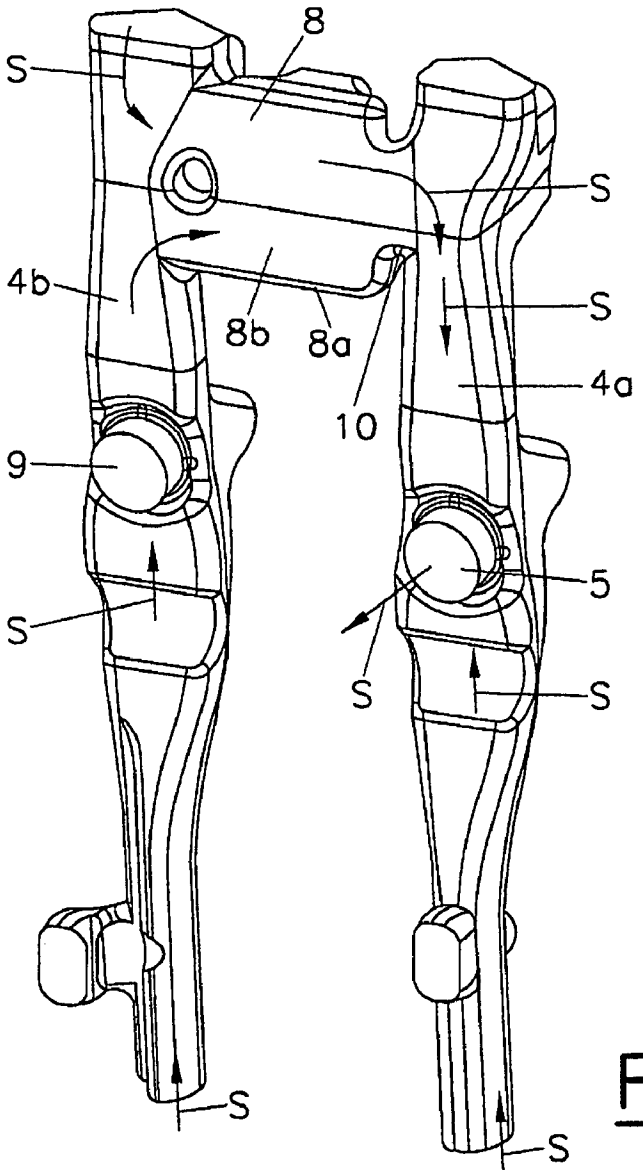
FIG. 5 shows two adjacent vertical reinforcements in a diagonal view.
Figure 7:
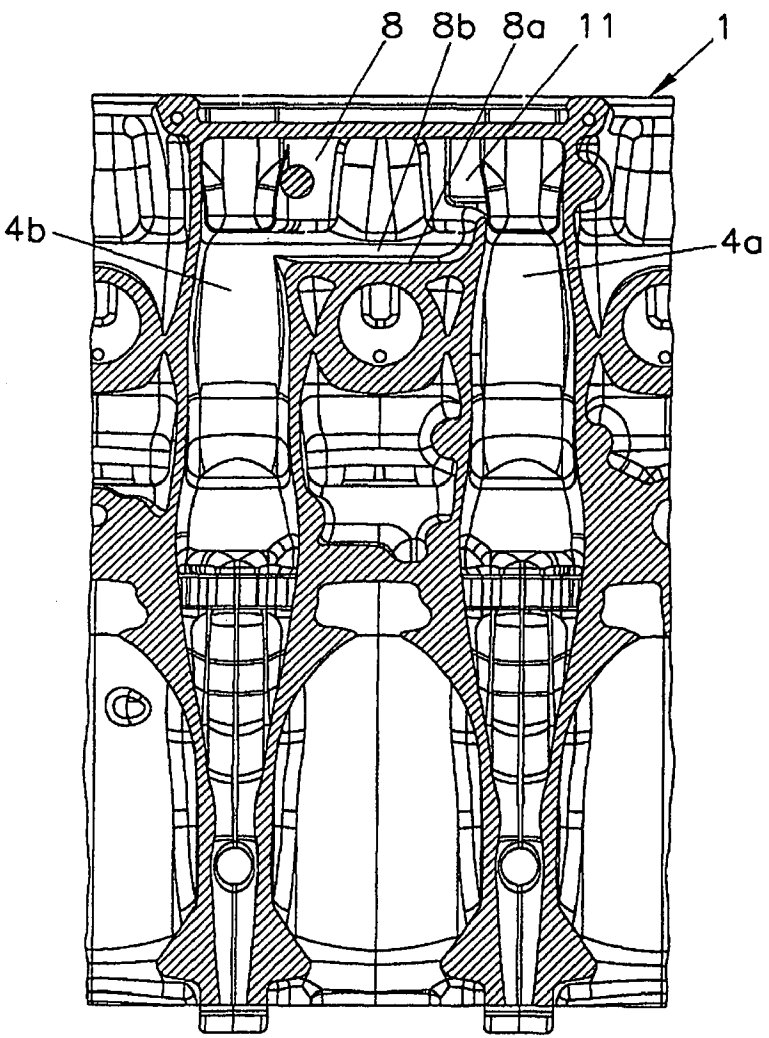
FIG. 7 shows the vertical reinforcements in a further longitudinal section.
Figure 6:
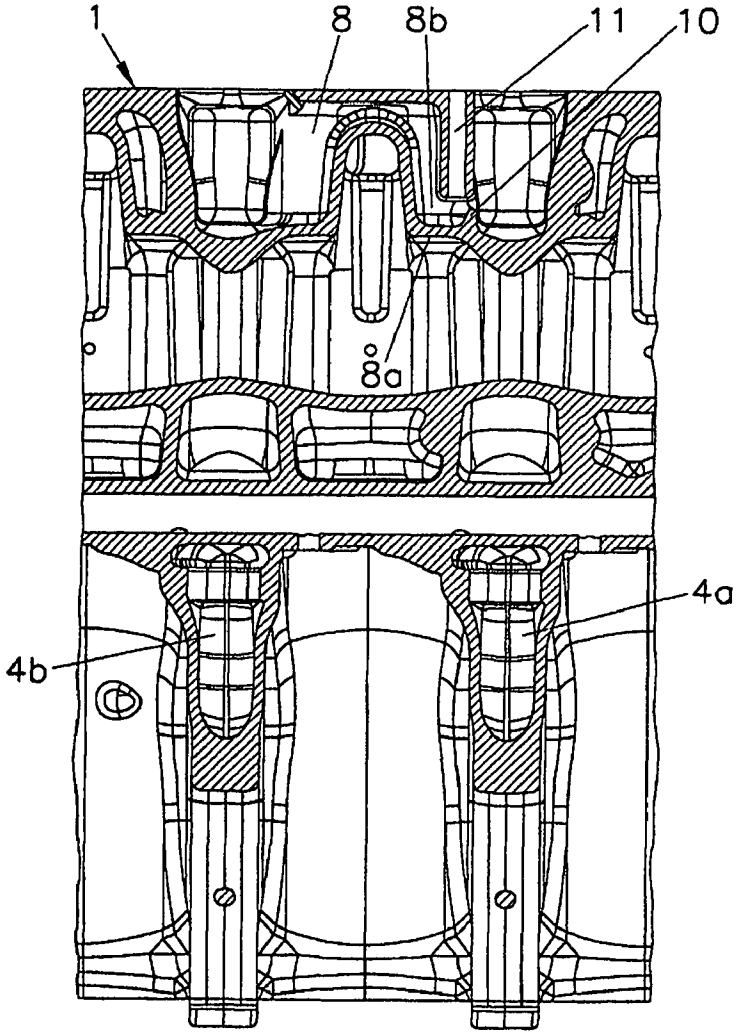
FIG. 6 shows the adjacent vertical reinforcements in a longitudinal section.

A connection channel 8, which connects the vertical reinforcements 4*a*, 4*b* to one another, is provided between the vertical reinforcement 4*a* having the connection 5 and an adjacent vertical reinforcement 4*b*. The blow-by gases thus flow in the vertical reinforcements 4*a*, 4*b* in the way shown by the arrows S in FIG. 5 out of the cylinder head and the crankcase through the connection 5 into the blow-by gas line 7. Cast openings, which are subsequently closed by lids, are identified by reference numeral 9.

The connection channel 8 has an oil separation edge 10, which prevents entrained oil from being introduced into the blow-by gas line 7, on its bottom side 8*a* in the area of the entry into the vertical reinforcement 4*a* having the connection 5. The connection channel 8 can be implemented in the area of its bottom side 8*a* as a collection chamber 8*b* for oil, so that oil held back by the oil separation edge 10 can drain into the adjacent hollow vertical reinforcement 4*b* in the direction of the crankcase. An oil recirculation line 11 can open into the oil collection chamber 8*b* of the connection channel 8 directly upstream from the oil separation edge 10. This oil recirculation line 11 is connected to a corresponding oil recirculation channel in the cylinder head, whose mouth is situated lower than the mouth of adjacent blow-by gas channels, which lead to the vertical reinforcements 4, 4*a*, 4*b*. In this way, the blow-by gases entering the vertical reinforcement 4*a* additionally entrain as few oil droplets as possible.

The invention claimed is:

1. An internal combustion engine having an engine block for a plurality of cylinders, which has side walls and hollow vertical reinforcements along the side walls of the engine block in areas of main bearing planes, at least a part of the reinforcements being implemented as oil recirculation passages between a cylinder head and engine block, wherein at least one vertical reinforcement which conducts blow-by gas has a connection for a blow-by gas line leading to an oil separator, wherein the vertical reinforcement having the connection for the blow-by gas line has a flow connection via a connection channel to an adjacent vertical reinforcement, wherein the connection channel has an oil separation edge on a bottom side of the connection channel farther away from the cylinder head in an area of the vertical reinforcement having the connection, said oil separation edge projecting upwardly from a bottom side, and wherein the connection channel is implemented as an oil collection chamber in order to conduct separated oil into the adjacent vertical reinforcement.

2. The internal combustion engine according to claim 1, wherein a first group of vertical reinforcements is implemented as oil recirculation passages and a second group of vertical reinforcements is implemented as blow-by passages, so that the oil recirculation and the flow of blow-by gases occur essentially separately from one another.

3. The internal combustion engines according to claim 2, wherein the first group of vertical reinforcements is situated on a first longitudinal side of the engine block and the second group of vertical reinforcements is situated on a second longitudinal side of the engine block.

4. The internal combustion engine according to claim 2, wherein the first group of vertical reinforcements is connected to oil recirculation channels in the cylinder head and the second group of vertical reinforcements is connected to blow-by gas channels in the cylinder head, the mouths of the oil recirculation channels of the cylinder head being situated lower than the mouths of the blow-by gas channels.

5. The internal combustion engine according to claim 1, wherein the connection channel is situated in an area of a cylinder in the side wall of the engine block crankcase.

6. The internal combustion engine according to claim 1, wherein the vertical reinforcement having the connection is situated approximately in the area of an engine central plane.

7. The internal combustion engine according to claim 1, wherein the vertical reinforcement having the connection is separated from the cylinder head by a cylinder head seal in the area of the cylinder head sealing surface, except for an oil recirculation opening.

8. The internal combustion engine according to claim 1, wherein the vertical reinforcement having the connection is separated from the cylinder head by a cylinder head seal in the area of the cylinder head sealing surface.

* * * * *

UNITED STATES PATENT AND TRADEMARK OFFICE

CERTIFICATE OF CORRECTION

PATENT NO. : 8,375,927 B2
APPLICATION NO. : 12/452667
DATED : February 19, 2013
INVENTOR(S) : Robert Berger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 373 days.

Signed and Sealed this
First Day of September, 2015

Michelle K. Lee

Michelle K. Lee
*Director of the United States Patent and Trademark Office*